US010767832B2

(12) United States Patent
Ahn et al.

(10) Patent No.: US 10,767,832 B2
(45) Date of Patent: Sep. 8, 2020

(54) LIGHT SOURCE MODULE FOR VEHICLE

(71) Applicant: LG INNOTEK CO., LTD., Seoul (KR)

(72) Inventors: Kyoung Soo Ahn, Seoul (KR); Sang Hyun An, Seoul (KR); Dong Il Eom, Seoul (KR); Jae Myeong Noh, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 16/099,849

(22) PCT Filed: May 15, 2017

(86) PCT No.: PCT/KR2017/005014
§ 371 (c)(1),
(2) Date: Nov. 8, 2018

(87) PCT Pub. No.: WO2017/200247
PCT Pub. Date: Nov. 23, 2017

(65) Prior Publication Data

US 2019/0113204 A1 Apr. 18, 2019

(30) Foreign Application Priority Data

May 16, 2016 (KR) ..... 10-2016-0059817

(51) Int. Cl.
*F21S 41/43* (2018.01)
*F21S 45/47* (2018.01)
(Continued)

(52) U.S. Cl.
CPC ..... *F21S 45/47* (2018.01); *F21S 41/147* (2018.01); *F21S 41/148* (2018.01);
(Continued)

(58) Field of Classification Search
CPC .. F21S 45/40; F21S 45/46; F21S 45/47; F21S 41/198; F21S 41/147; F21S 41/148;
(Continued)

(56) References Cited

U.S. PATENT DOCUMENTS 4,669,186 A * 6/1987 Liu ..... F21V 33/0064 362/119
2010/0033981 A1* 2/2010 Chien ..... F21K 9/00 362/487
(Continued)

FOREIGN PATENT DOCUMENTS

DE 20 2015 107084 1/2016
JP 2015-050177 3/2015
(Continued)

OTHER PUBLICATIONS

European Search Report dated Feb. 18, 2019 issued in Application No. 17799605.5.
(Continued)

*Primary Examiner* — Y M. Quach Lee
(74) *Attorney, Agent, or Firm* — KED & Associates LLP

(57) ABSTRACT

The present invention provides a light source module for a vehicle comprising: a plate-like heat sink; substrates provided on both sides of the heat sink, respectively; light emitting devices provided on the substrates, respectively; a hole for transmitting light emitted from the light emitting devices; and a pair of bases coupled to the outside of the substrates, wherein the light emitting device includes a first light emitting device and a second light emitting device which are arranged diagonally, and a blocking member is disposed at a lower end of the second light emitting device. As such, it is possible to increase the heat dissipation efficiency by increasing the contact between the heat sink and the substrates.

14 Claims, 9 Drawing Sheets

(51) Int. Cl.

| | |
|---|---|
| ***F21S 45/49*** | (2018.01) |
| ***F21S 41/47*** | (2018.01) |
| ***F21S 41/19*** | (2018.01) |
| ***F21S 41/148*** | (2018.01) |
| ***F21S 41/663*** | (2018.01) |
| ***F21V 29/51*** | (2015.01) |
| ***F21S 41/147*** | (2018.01) |
| ***F21S 43/14*** | (2018.01) |
| ***F21S 43/19*** | (2018.01) |
| ***F21S 41/40*** | (2018.01) |
| *F21W 102/13* | (2018.01) |
| *F21Y 107/90* | (2016.01) |
| *F21Y 105/12* | (2016.01) |

(52) U.S. Cl.
CPC ..... *F21S 41/192* (2018.01); *F21S 41/198* (2018.01); *F21S 41/40* (2018.01); *F21S 41/43* (2018.01); *F21S 41/47* (2018.01); *F21S 41/663* (2018.01); *F21S 43/14* (2018.01); *F21S 43/19* (2018.01); *F21S 45/49* (2018.01); *F21V 29/51* (2015.01); *F21W 2102/13* (2018.01); *F21Y 2105/12* (2016.08); *F21Y 2107/90* (2016.08)

(58) Field of Classification Search
CPC .. F21S 43/14; F21S 43/19; F21S 41/40; F21S 41/43; F21V 29/51; F21Y 2105/12
See application file for complete search history.

(56) References Cited

U.S. PATENT DOCUMENTS

| | | | | |
|---|---|---|---|---|
| 2011/0058384 | A1 | 3/2011 | Boroczki et al. | |
| 2016/0305625 | A1 | 10/2016 | Wu | |
| 2017/0146211 | A1* | 5/2017 | Wu ..... | F21S 41/192 |

FOREIGN PATENT DOCUMENTS

| | | |
|---|---|---|
| JP | 3197657 | 5/2015 |
| KR | 20-0355339 | 7/2004 |
| KR | 10-2012-0049329 | 5/2012 |
| KR | 10-2013-0114359 | 10/2013 |
| KR | 10-1533709 | 7/2015 |
| KR | 10-2016-0045302 | 4/2016 |
| WO | WO 2014/148805 | 9/2014 |

OTHER PUBLICATIONS

International Search Report (with English Translation) and Written Opinion dated Aug. 10, 2017 issued in Application No. PCT/KR2017/005014.

* cited by examiner

LIGHT SOURCE MODULE FOR VEHICLE

CROSS-REFERENCE TO RELATED PATENT APPLICATIONS

This application is a U.S. National Stage Application under 35 U.S.C. 371 of PCT Application No. PCT/KR2017/005014, filed May 15, 2017, which claims priority to Korean Patent Application No. 10-2016-0059817, filed May 16, 2016, whose entire disclosures are hereby incorporated by reference.

TECHNICAL FIELD

Embodiments of the present invention relate to a light source module for a vehicle.

BACKGROUND ART

Generally, various lamps are provided in a vehicle to secure visibility of a driver by emitting light forward according to an external environment and time and inform a traveling path to the other vehicle.

The lamps are classified according to the purpose of use, such as headlamps having a purpose of illuminating a forward direction, turn signal lamps having a purpose of securing visibility of the driver and informing a position of the vehicle, fog lamps configured to secure visibility of the driver and informing a position of the vehicle along with the headlamps in foggy or rainy weather, and backup lamps configured to turn on when the vehicle is reversed.

Halogen bulbs have been mainly used as conventional lamps for a vehicle. When halogen lamps are used as a light source, reflectors configured to reflect light emitted from the halogen lamps are provided, and the light reflected from the reflectors is emitted forward. However, while halogen lamps have an advantage of being inexpensive, the halogen lamps have a disadvantage in that the halogen lamps generate a large amount of heat when being used and have a low luminance compared to the amount of electricity being used and a short lifespan.

In order to solve such a problem, lamps for a vehicle using light emitting diodes (LEDs) are emerging. LED lamps have advantages of high luminance, long lifespan, and low power consumption.

However, headlamps to which LEDs with high luminance are applied generate extremely high heat when the LEDs are turned on, and thus there is a limit in that parts around the LEDs are thermally deformed, thereby reducing durability of the headlamps. Accordingly, for lamps to which LED light sources are applied, a heat dissipation structure is the most important matter.

DISCLOSURE

Technical Problem

Embodiments of the present invention are directed to providing a light source module for a vehicle, which is easily assembled and separated by assembling the light source module using a snap ring.

Embodiments are also directed to providing a light source module for a vehicle capable of increasing heat dissipation efficiency through a double heat dissipation structure of a heat pipe and a heat sink.

Objectives to be achieved by the embodiments of the present invention are not limited to the above-described objectives, and other objectives, which are not described above, may be clearly understood by those skilled in the art through the following specification.

Technical Solution

Embodiments of the present invention include a heat pipe having a plate shape, a pair of substrates provided on both sides of the heat pipe, respectively, light-emitting devices provided on the substrates, respectively, and a pair of bases including a through hole configured to transmit light emitted from the light-emitting device and connected to outer sides of the pair of substrates.

The plurality of light-emitting devices may be provided and diagonally arranged on each of the substrates, the plurality of light-emitting devices may be divided into a low beam and a high beam, and a blocking member formed to protrude from the base may be included.

The blocking member may be positioned below the low beam and may have a surface contacting light emitted from the low beam, one area of which has a right-angled shape.

The plurality of light-emitting devices may be divided into a first light-emitting device and a second light-emitting device, and the second light-emitting device forming the low beam may have a distance of 0.02 mm to 0.2 mm from the blocking member.

The second light-emitting device may have a spacing distance of 2.5 mm to 4.0 mm from an outer wall of the base forming a through hole.

The pair of bases may form a cylindrical shape by being coupled to each other, and outer circumferential surfaces of the pair of bases may be coupled to each other through at least one snap ring.

A seating groove for seating the snap ring may be formed on the base.

A separating groove recessed inward may be formed in one area of the seating groove so that the snap ring is easily separated.

The snap ring may be provided in a circular strap shape having a certain thickness, and one area of the snap ring may have an opening.

The substrate may be divided into a first substrate and a second substrate, and the first substrate and the second substrate may be provided in different shapes.

The heat pipe may be connected to a heat sink.

The heat sink may be screw-coupled to the base.

An inner space for seating the substrates may be formed in the pair of bases, and the inner space may be divided into a close contact space of both the substrates and a spacing space configured to prevent wiring of the substrates from interference.

Terminals of the pair of substrates may be electrically connected through wires, and a terminal space through which the wires pass may be formed in the pair of bases.

A coupling part may be provided in one area of an outside of the base.

The coupling part may be provided with an insertion groove to be coupled to the base, and a rotation preventing part configured to prevent the base from rotating may be formed in one area of the insertion groove.

Advantageous Effects

According to an embodiment, there is an effect in which a heat dissipation effect can be enhanced by increasing contact between a heat pipe and a substrate.

Further, an inner space of the light source module can be secured by coupling bases using a snap ring, and attachment and detachment can be facilitated.

Various advantages and effects of the present invention are not limited to the above description and can be more easily understood during the description of specific exemplary embodiments of the present invention.

MODES OF THE INVENTION

Figure 1:
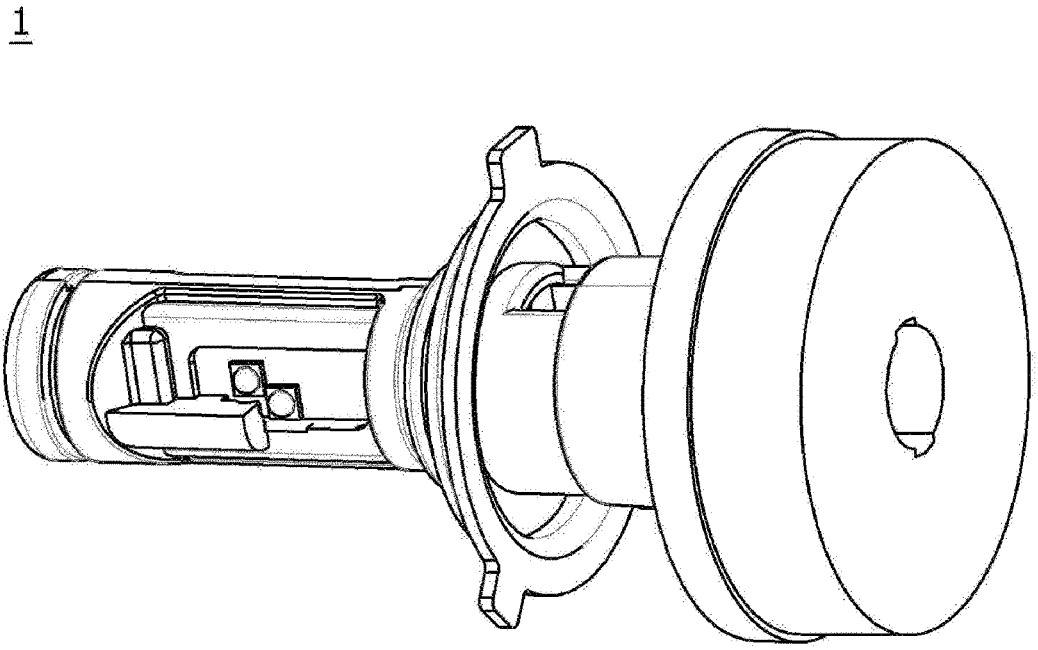
FIG. 1 is a perspective view of a light source module for a vehicle according to an embodiment of the present invention.

The present invention may be modified in various forms and have various embodiments, and thus particular embodiment thereof will be illustrated in the accompanying drawings and described in the detailed description. It should be understood, however, that there is no intent to limit the embodiments of the present invention to the particular forms disclosed, but on the contrary, the embodiments are to cover all modifications, equivalents, and alternatives falling within the spirit and scope of the present invention.

Although the terms encompassing ordinal numbers such as first, second, etc. may be used to describe various elements, these elements are not limited by these terms. These terms are only used to distinguish one element from another. For example, a first element could be termed a second element, and similarly, a second element could be also termed a first element, without departing from the scope of the embodiments. As used herein, the term "and/or" includes any and all combinations of one or more of the associated listed items.

The terminology provided herein is merely used for describing particular embodiments and is not intended to be limiting of the embodiments. The singular forms "a" and "an" are intended to include the plural forms as well, unless the context clearly indicates otherwise. In the present invention, it will be further understood that the terms "comprise," "comprising," "include," and/or "including" when used in this specification, specify the presence of stated features, integers, steps, operations, elements, components and/or groups thereof, but do not preclude the presence or addition of one or more other features, integers, steps, operations, elements, components and/or groups thereof.

In the description of the embodiments, when an element is referred to as being "on or under" another element, the term "on or under" refers to either a direct connection between two elements or an indirect connection between two elements having one or more elements formed therebetween. In addition, when the term "on or under" is used, it may refer to a downward direction as well as an upward direction with respect to an element.

Hereinafter, exemplary embodiments of the present invention will be described in detail with reference to the accompanying drawings. Regardless of reference numerals, like numbers refer to like elements throughout the description of the figures, and the description of the same elements will be not reiterated.

Figure 2:
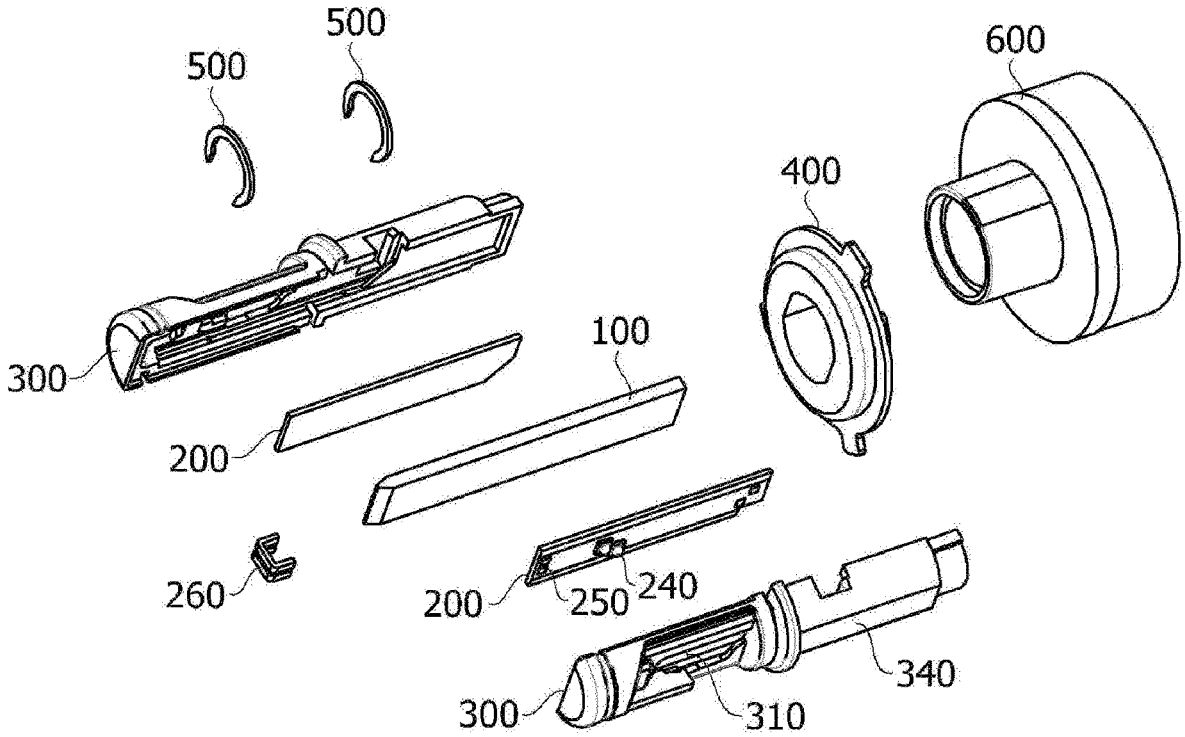
FIG. 2 is an exploded perspective view of FIG. 1.

FIG. 1 is a perspective view of a light source module for a vehicle according to an embodiment of the present invention, and FIG. 2 is an exploded perspective view of the light source module for a vehicle.

Referring to FIGS. 1 and 2, a light source module 1 for a vehicle according to the embodiment of the present invention includes a heat pipe 100, a substrate 200, a light-emitting device 240, a base 300, a coupling part 400, a snap ring 500, and a heat sink 600.

The heat pipe 100 transmits heat generated from a light source to the heat sink 600. As one example, a light emitting diode (LED) may be used as the light-emitting device. When the LED is used as the light source, it has an advantage in low power and high efficiency but has a disadvantage in that a large amount of heat is generated. In order to solve such a problem, the heat pipe 100 may be formed of a metal having high heat conduction efficiency to dissipate the heat generated from the light-emitting device 240.

As one example, the heat pipe 100 is provided in a plate shape to increase a contact area with the substrate 200 and may be in surface contact with the substrate 200.

The substrates 200 contact left and right sides of the heat pipe 100 and may include at least one light-emitting device 240. The substrate 200 may be provided in an elongated plate shape to contact the heat pipe 100 and may have a plurality of terminals 250 for being electrically connected. As one example, a heat pipe may be used for the heat pipe 100.

A plurality of light-emitting devices 240 may be provided to perform different roles and may be used in various colors. As one example, when the light source module 1 for a vehicle is used for a headlamp of the vehicle, the substrate 200 may be provided with a pair of light-emitting devices 240, and each of the light-emitting devices 240 may operate as a high beam and a low beam.

A hole is formed in the base 300 to transmit light emitted from the light-emitting device 240. Further, a pair of holes may be formed in the shape of a through hole 310 to be connected to outer sides of the pair of substrates 200. A pair of bases 300 are coupled to surround outer sides of the substrates 200 and heat pipe 100. As one example, the pair of bases 300 may be coupled to each other to form a cylindrical shape. Further, the entire bases 300 may be formed of a material having a high thermal conductivity to dissipate the heat generated from the light-emitting device 240 to the outside.

The coupling part 400 is provided so as to protrude from an outer side surface of the base 300 and may fix the position of the light source module when the light source module is coupled to the lamp. The coupling part 400 may be integrally formed with the outer sides of the bases 300 or may be manufactured in a separate structure and connected to the bases 300.

As one example, when the coupling part 400 is manufactured in the separate structure, a third groove for insertion of the base 300 may be formed in the coupling part 400, and the third groove may be formed as an insertion groove. Further, a rotation preventing part 340 may be formed in one area of the insertion groove to prevent a problem, in which the light emitted from the light-emitting device 240 is not directed to the through hole 310 due to a rotation of the base 300. The rotation preventing part 340 may prevent the base 300 from rotating when the base 300 is inserted. As one example, the light source module may be prevented from rotating by forming a linear shaped corner on the circular shaped base 300 and forming a shape of the insertion groove to correspond to the linear shaped corner.

Further, the coupling part 400 may be provided as a separate structure so that tolerances generated when the coupling part 400 is coupled to and assembled with the base 300 may be adjusted. Generally, when the light source module using the light-emitting device 240 is installed in a vehicle, the light source module using the light-emitting device 240 is connected to a reflector. Here, when the light source module is connected to various kinds of reflectors, tolerances may be generated with respect to the reflector of each company, and a spacer (not shown) may be connected to a front surface or a rear surface of the coupling part 400 to adjust the tolerance at the time of assembly. A shape of the spacer is not limited and may be provided in a plate shape to adjust the tolerance.

The snap ring 500 may be coupled to an outer circumferential surface of the base 300 to assemble the light source module. As one example, when the base 300 is provided in the cylindrical shape, at least one snap ring 500 may be coupled to the outer circumferential surface of the base 300.

In a conventional light source module using a light-emitting device, when the heat pipe 100 is used to dissipate heat, the heat sink 600 may not be used, or there is a problem of fixing during assembly. Further, when the heat pipe 100 is not used, a heat dissipation fan is required due to heat dissipation problems, which increase the cost.

Thus, when the bases 300 are coupled to each other using the snap ring 500, the problem of penetration of the heat pipe 100 that may occur when a bolt is used may be solved, and additional structure may be omitted, thereby reducing costs and increasing heat dissipation efficiency.

The heat sink 600 may be connected to the base 300 to dissipate the heat conducted from the heat pipe 100 and the base 300 to the outside. A shape of the heat sink 600 is not limited, and various structures for increasing the heat dissipation efficiency may be used.

Figure 3:
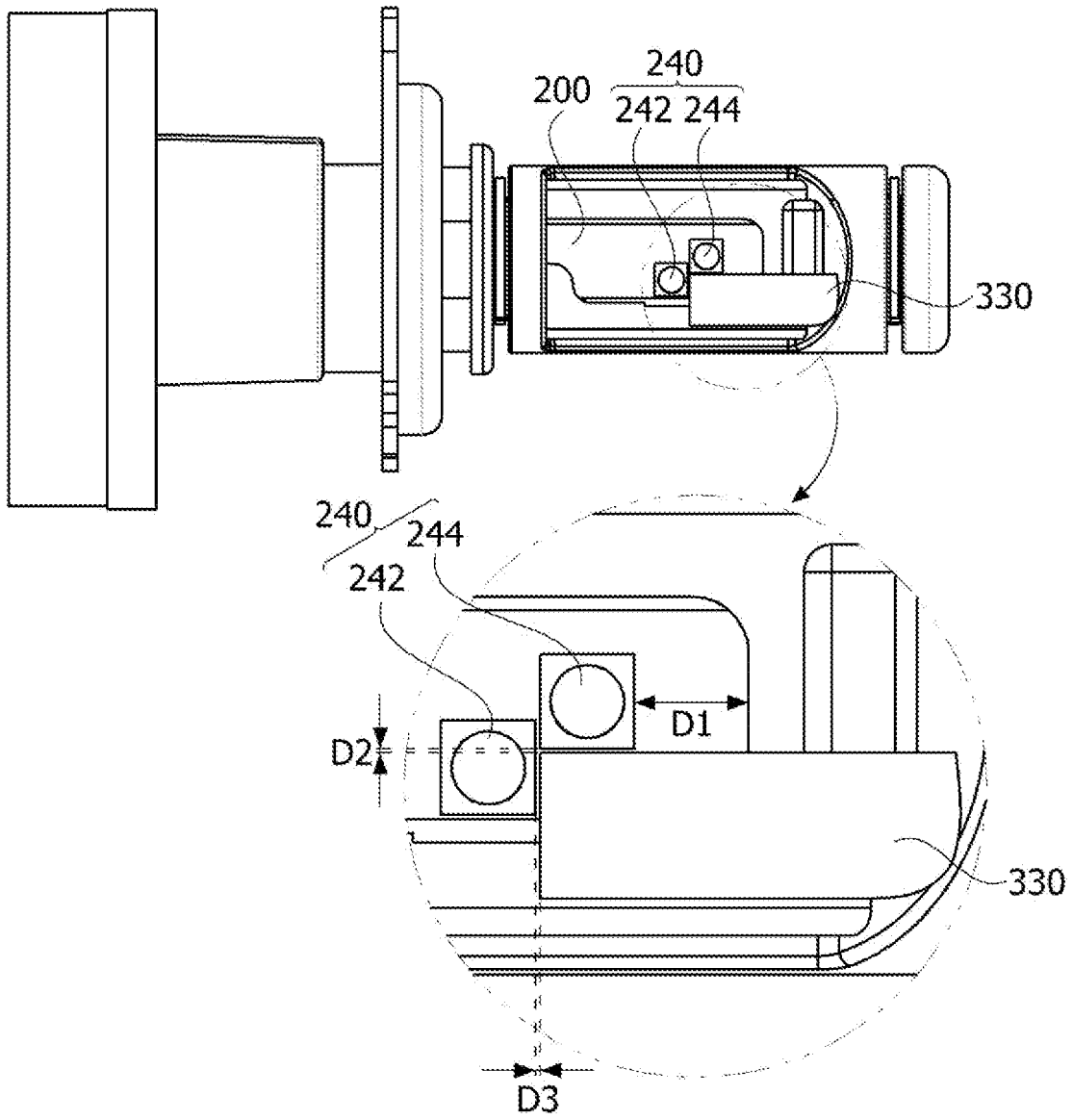
FIG. 3 is a view illustrating positions of light-emitting devices and a blocking member, which are components of FIG. 1.
Figure 4:
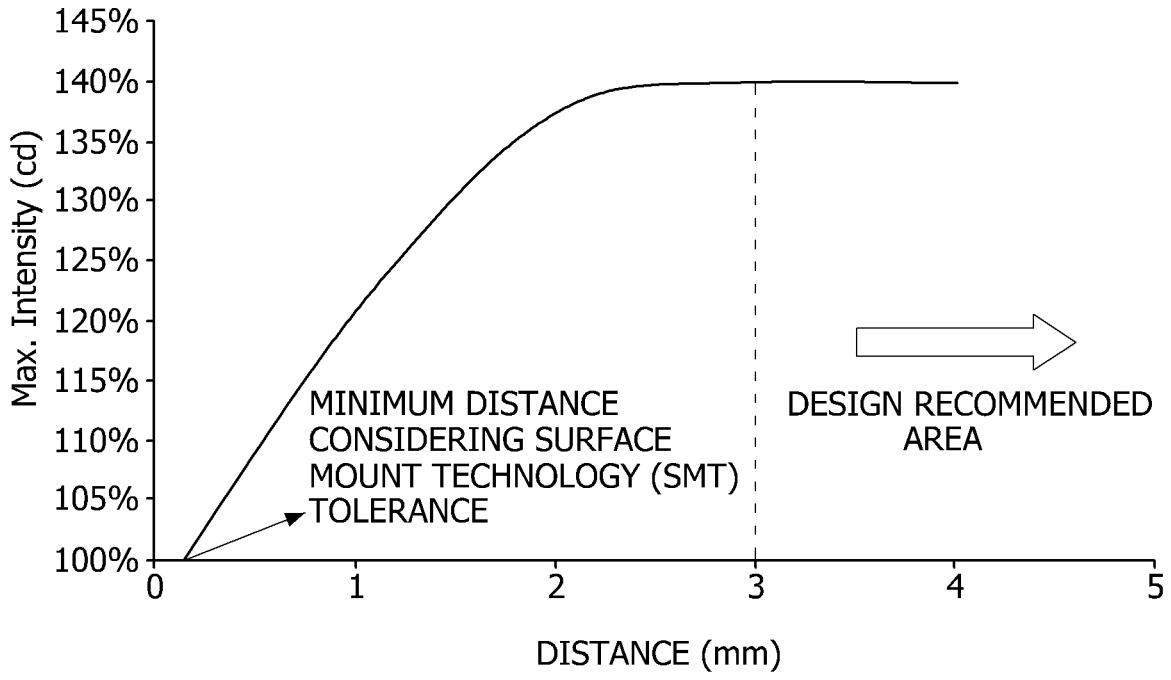
FIG. 4 is a graph illustrating intensity of light according to a spacing distance between a base and the light-emitting device in FIG. 3.
Figure 5:
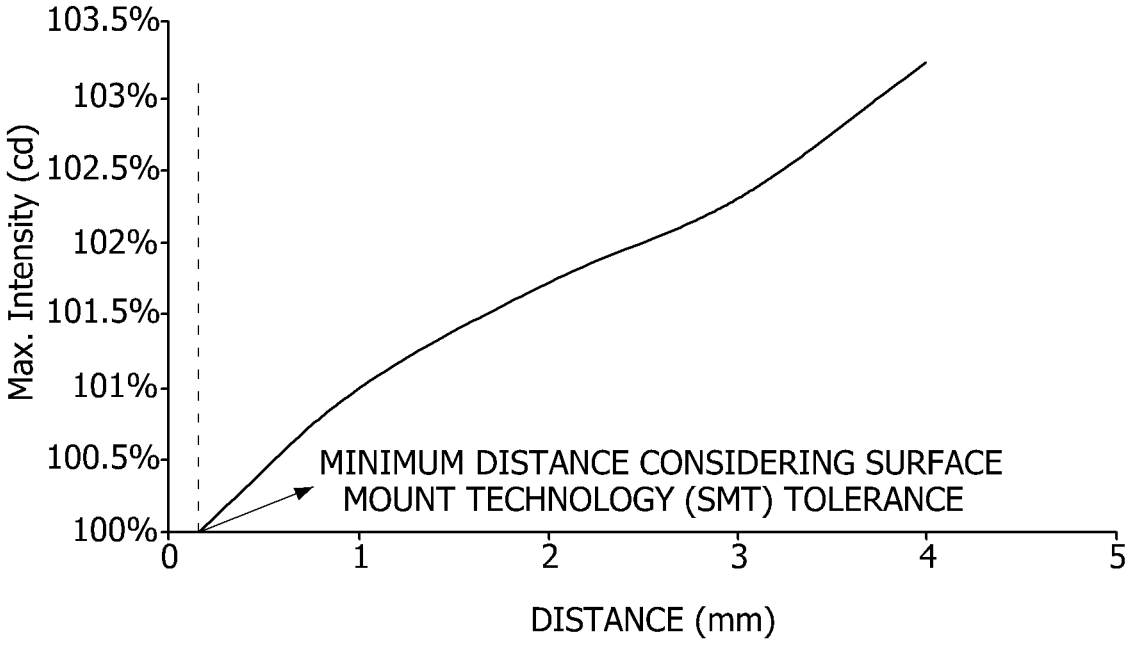
FIG. 5 is a graph illustrating intensity of light according to a spacing distance between the blocking member and the light-emitting device in FIG. 3.

FIG. 3 is a view illustrating positions of the light-emitting devices and a blocking member, which are components of the light source module for a vehicle, FIG. 4 is a graph illustrating intensity of the light according to a spacing distance between the base and the light-emitting device in the light source module for a vehicle, and FIG. 5 is a graph illustrating intensity of the light according to a spacing distance between the blocking member and the light-emitting device in the light source module for a vehicle.

Referring to FIGS. 3 to 5, the plurality of light-emitting devices 240 may be provided on the substrate 200 to operate as the high beam and the low beam. A light distribution regulation shall be satisfied in the case of low beam in order not to interfere with visibility of a driver of a vehicle traveling in the opposite lane while driving the vehicle. A blocking member 330 is provided in one area of the base 300 to satisfy such a light distribution regulation.

The plurality of light-emitting devices 240 may be divided into a first light-emitting device 242 and a second light-emitting device 244, and the first light-emitting device 242 and the second light-emitting device 244 may be diagonally arranged. Here, the first light-emitting device 242 operates as the high beam and the second light-emitting device 244 operates as the low beam.

The blocking member 330 is positioned below the second light-emitting device 244, and thus, when the second light-emitting device 244 emits the light, one area of the second light-emitting device 244 is blocked and reflected to the outside of the vehicle through the reflector, thereby satisfying the light distribution regulation.

Referring to FIGS. 2 and 3, the blocking member 330 may be formed such that one area of a surface of the blocking member 330 contacting the light has a right-angled shape to block the light emitted from the second light-emitting device 244. A distance D3 at which the first light-emitting device 242 is separated from the blocking member 330 may be variously modified to satisfy the light distribution regulation for the low beam.

The second light-emitting device 244 may have a spacing distance of 2.5 mm to 4.0 mm from a sidewall of the base 300 forming the through hole 310. Referring to FIG. 4, it may be seen that certain light intensity is secured when a spacing distance D1 between the second light-emitting device 244 and an outer wall of the base 300 forming the through hole 310 is 2.5 mm or more. However, when the distance increases excessively, the entire size of the light source module increases, and thus the distance may be limited to a certain range, and preferably the spacing distance D1 may have a distance of 3 mm.

Further, the second light-emitting device 244 may have a spacing distance D2 of 0.02 mm to 0.2 mm from the blocking member 330. Referring to FIG. 5, a blocking effect of the light emitted from the second light-emitting device 244 increases as the spacing distance at which the second light-emitting device 244 is separated from the blocking member 330 is closer. However, a certain spacing distance should be provided to facilitate assembly and to prevent breakage of the light-emitting device 240, and accordingly, the spacing distance may have a distance of 0.02 to 0.2 mm, and preferably, the spacing distance d2 may have a distance of 0.15 mm.

Figure 6:
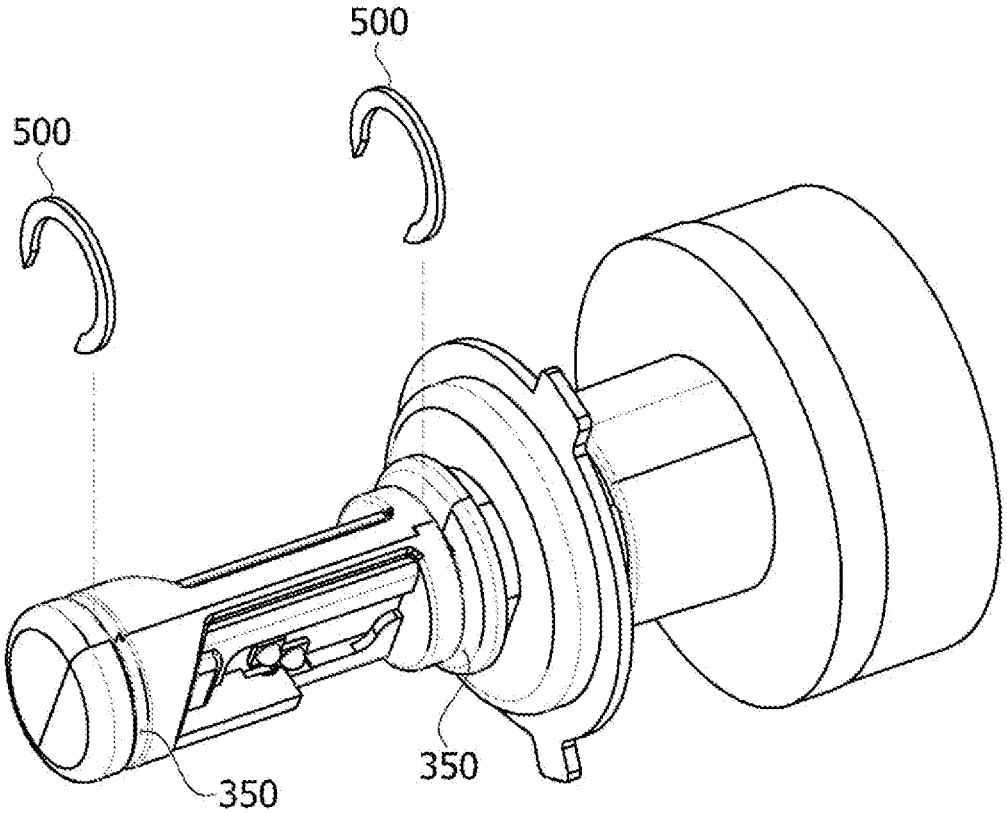
FIG. 6 is a view illustrating a coupling structure of a snap ring for assembling the light source module of FIG. 1.
Figure 7:
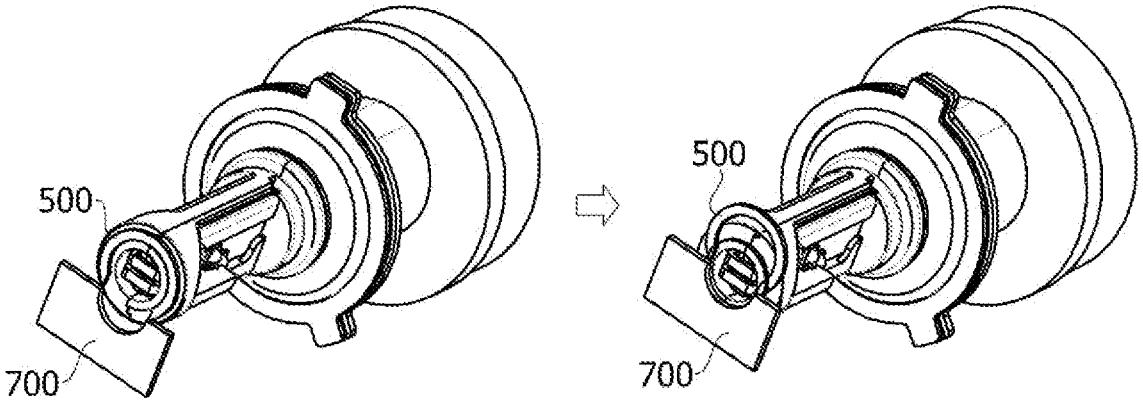
FIG. 7 is a view illustrating a process of separating the snap ring of FIG. 6.
Figure 8:
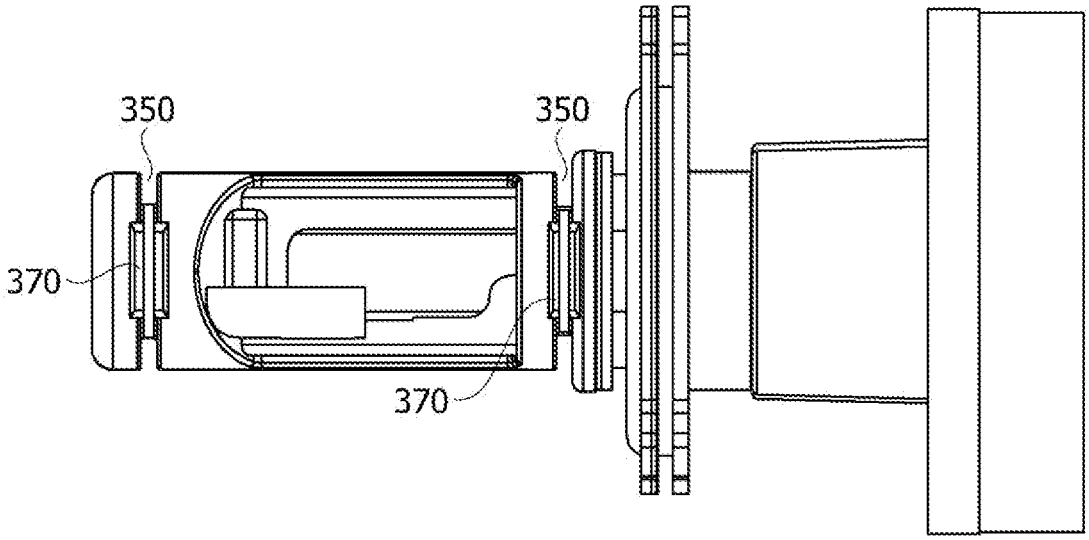
FIG. 8 is a view illustrating another configuration for separating the snap ring of FIG. 6.

FIG. 6 is a view illustrating a coupling structure of the snap ring for assembling the light source module for a vehicle, FIG. 7 is a view illustrating a process of separating the snap ring, and FIG. 8 is a view illustrating another configuration for separating the snap ring.

Referring to FIGS. 6 to 8, the pair of base 300 may form a cylindrical shape by being coupled to each other, and the outer circumferential surfaces of the cylindrical shaped base 300 may be connected to each other through at least one snap ring 500.

Referring to FIG. 6, a plurality of snap rings 500 may be provided to connect the outer surfaces of the base 300 to each other, and a first groove for seating the snap ring 500 may be formed in the base 300, and a seating groove 350 may be formed in the first groove.

The snap ring 500 is provided in a circular strap shape having a certain thickness, and an opening is present in one area thereof, so that the snap ring 500 may be coupled to and separated from the base 300 by elasticity.

In order to repair an inside of the light source module, the base 300 needs to be separated, and FIG. 7 illustrates a method of separating the snap ring 500 using a jig 700.

The opening formed in the snap ring 500 is formed to be smaller than a diameter of the base 300, which is surrounded by the snap ring 500, to prevent the snap ring 500 from being separated. The jig 700 may be provided with a groove whose shape matches a shape of the outer surface of the base 300, which is surrounded by the snap ring 500, and may be provided such that a support part of the jig 700 comes into contact with both side ends of the snap ring 500. The support part of the jig 700 pushes up the snap ring 500 to cause an elastic deformation of the snap ring 500 so that the snap ring 500 may be easily separated.

Further, referring to FIG. 8, a second groove recessed into the seating groove 350 may be formed in one area of the seating groove 350 in which the snap ring 500 is mounted, and a separating groove 370 is formed in the second groove, so that the snap ring 500 may be easily separated.

The separating groove 370 may form a gap between the base 300 and the snap ring 500 even when the snap ring 500 is mounted, and the snap ring 500 may be easily removed using various devices even when the jig 700 is not provided.

Figure 9:
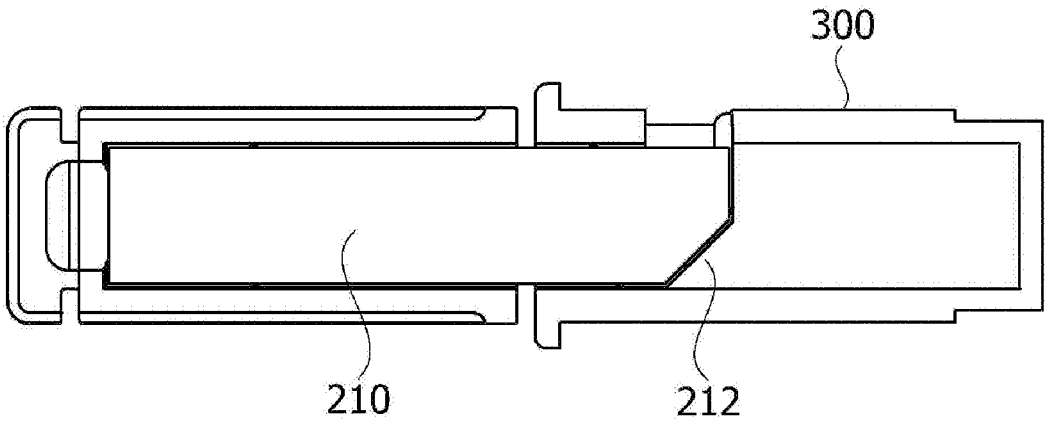
FIG. 9 is a view illustrating a shape of a first substrate coupled to the base.
Figure 10:
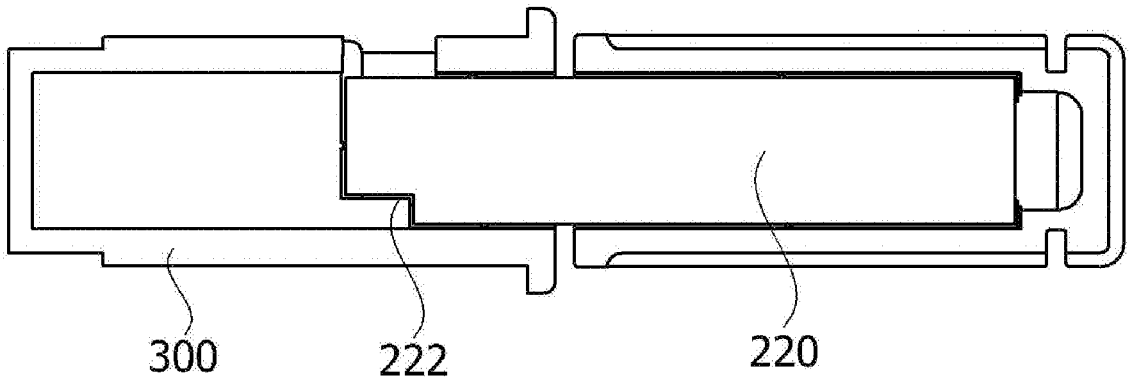
FIG. 10 is a view illustrating a shape of a second substrate coupled to the base.

FIG. 9 is a view illustrating a shape of a first substrate coupled to the base, and FIG. 10 is a view illustrating a shape of a second substrate coupled to the base.

Referring to FIGS. 9 and 10, a pair of substrates 200 may be provided and connected to both sides of the heat pipe 100 having a plate shape. The light-emitting device 240 is positioned on each of the substrates 200, and the substrate 200 should be positioned such that the light-emitting device 240 faces outward. Here, when both the substrates 200 have the same shape, both the substrates 200 may be connected in reverse while being assembled, and thus, in order to prevent this, a first substrate 210 and a second substrate 220 may be provided in different shapes.

When the shapes of the first substrate 210 and the second substrate 220 are changed, the shapes of the bases 300 on which the substrates 200 are disposed should also be changed to match the shapes of the first substrate 210 and the second substrate 220.

As one example, a diagonal shaped edge 212 may be provided on the first substrate 210 and a step-shaped edge 222 may be provided on the second substrate 220 to prevent from being misassembled.

Figure 11:
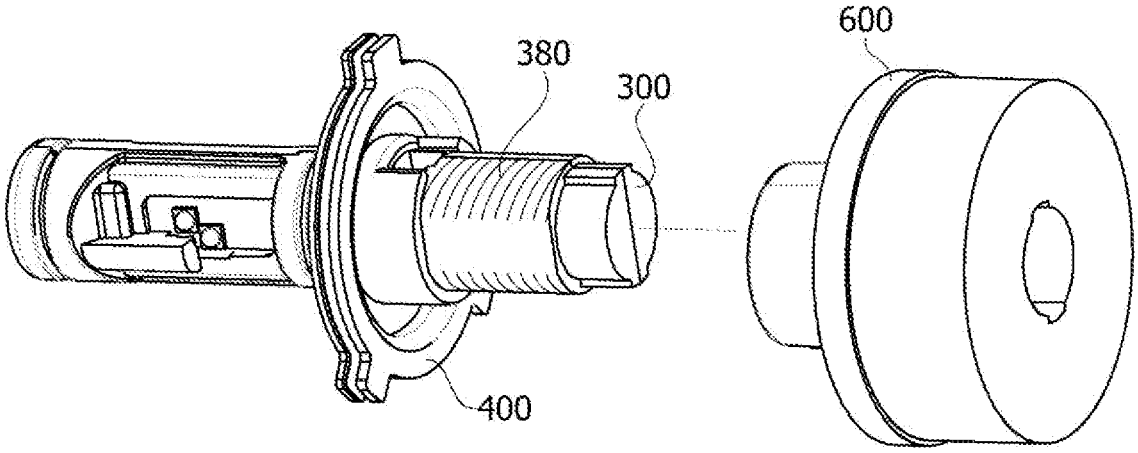
FIG. 11 is a view illustrating a configuration in which a heat sink is coupled to the base.

FIG. 11 is a view illustrating a configuration in which the heat sink is coupled to the base.

Referring to FIG. 11, the heat sink 600 may be connected to the heat pipe 100. The heat pipe 100 may be coupled in an entirely wrapped form by the base 300, and the heat sink 600 is connected to the base 300 formed of a thermally conductive material to receive the heat transmitted through the heat pipe 100.

The heat sink 600 may be formed in various structures to increase heat dissipation efficiency, and as one example, the heat sink 600 may be provided in a plurality of fin shapes to increase a heat dissipating area.

Further, the heat sink 600 may be screw-coupled to the base 300.

When the heat sink 600 is screw-coupled to the base 300, a screw thread 380 is formed on the base 300. When the base 300 is connected to the heat sink 600, a contact between the substrate 200 and the heat pipe 100 may be increased and the heat sink 600 may be easily attached and detached by pressing the base 300.

Figure 12:
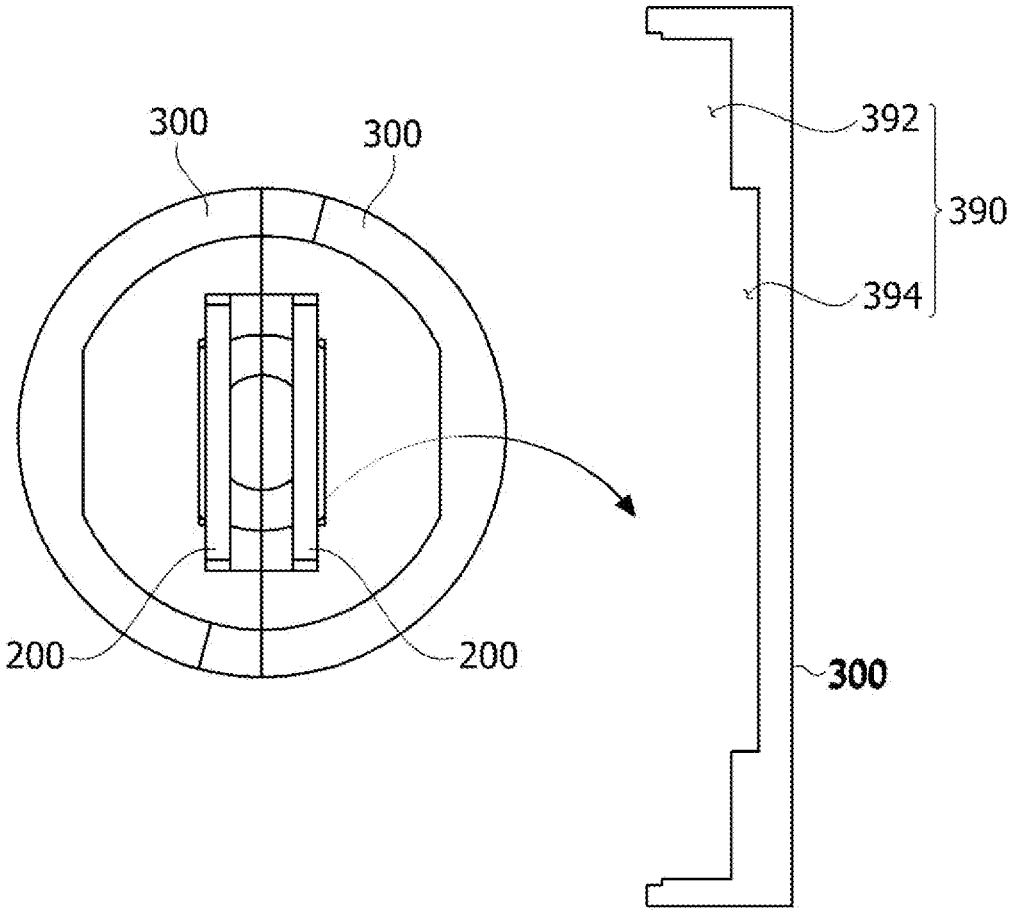
FIG. 12 is a view illustrating an internal structure of the base accommodating the substrates.

FIG. 12 is a view illustrating an internal structure of the base accommodating the substrates.

Referring to FIG. 12, the base 300 may be provided with an inner space 390 to accommodate the substrate 200.

The inner space 390 may be divided into a close contact space 392 into which the substrate 200 is inserted and which closely contacts the substrate 200 with the heat pipe 100, and a spacing space 394 for preventing a wiring area of the substrate 200 from being pressed to break a circuit of the substrate 200 or interfere with the wiring.

Circuit wirings (copper foil patterns) are not formed in a portion of the substrate 200, which is positioned in the close contact space 392, and a shape of the spacing space 394 may be modified in accordance with a shape of the circuit wirings of the substrate 200.

Figure 13:
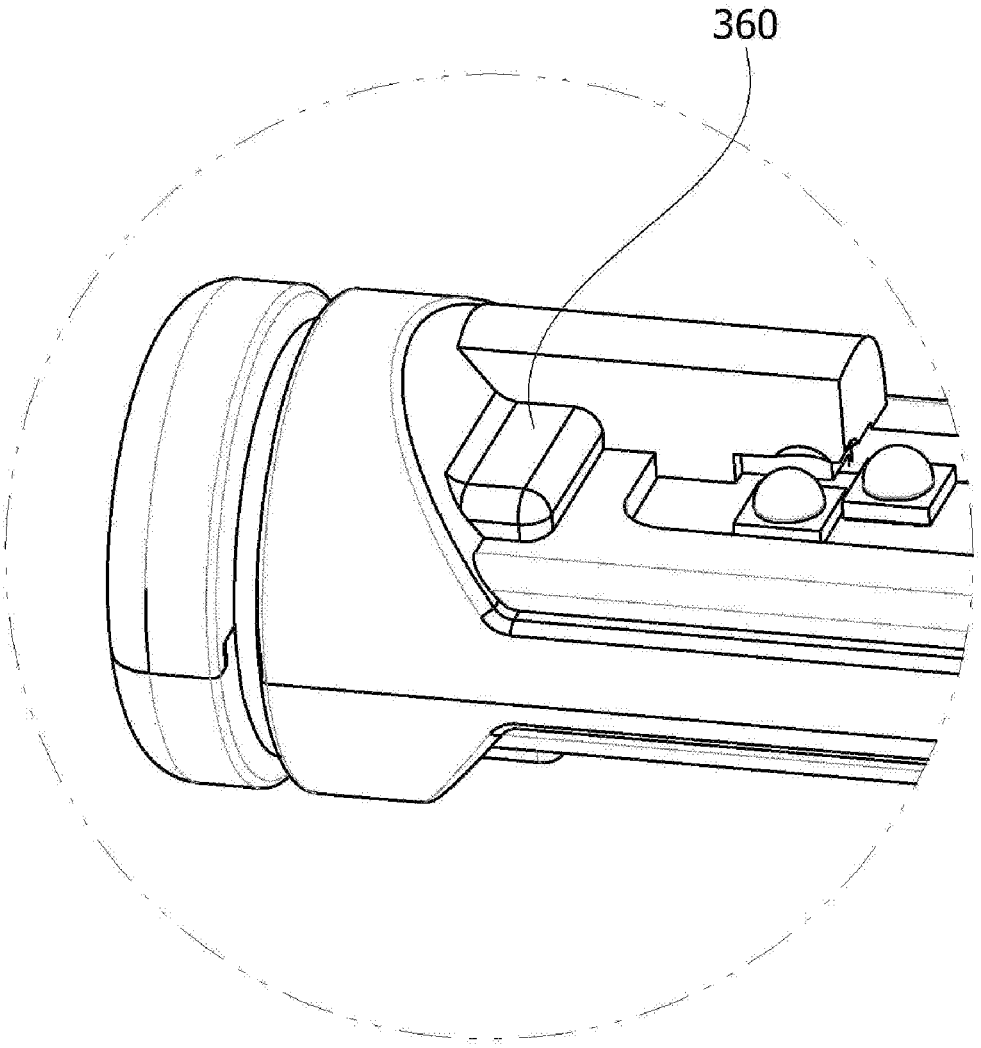
FIG. 13 is an enlarged view of the base forming a terminal space.
Figure 14:
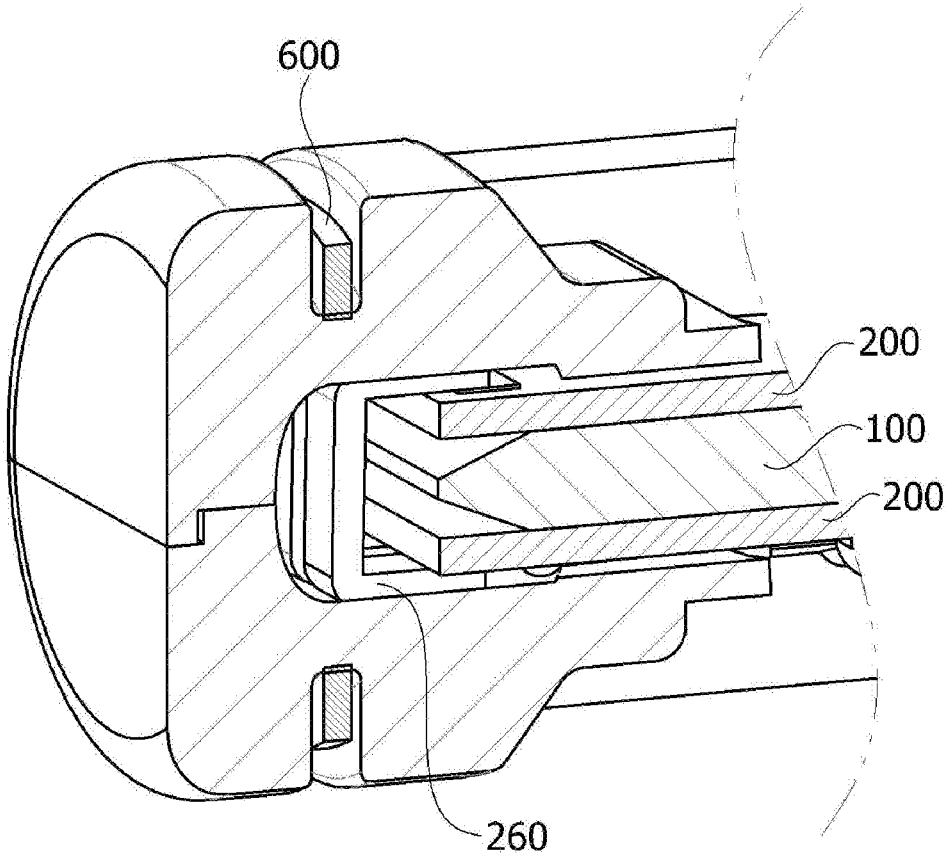
FIG. 14 is a view illustrating a structure in which a terminal connects the substrates inside the terminal space.

FIG. 13 is an enlarged view of the base forming a terminal space, and FIG. 14 is a view illustrating a structure in which a terminal connects the substrates inside the terminal space.

Referring to FIGS. 13 and 14, a terminal space 360 through which wires 260 connecting a terminal 250 of the substrate 200 pass may be formed in the base 300.

The substrate 200 is provided with the plurality of terminals 250 and both the substrates 200 are electrically connected through the wires 260. Here, when the wire 260 comes into contact with the base 300, an electrical problem may occur, and thus, in order to prevent this, the terminal space 360 may be formed on a front surface of the substrate 200, on which the terminal 250 is positioned.

The terminal space 360 may be modified according to the shape of the wire 260 connecting the terminal 250. As one example, when the wire 260 is provided in a 'C' shape, the terminal space 360 may be formed in a quadrangular shape.

As described above, the embodiments of the present invention have been specifically viewed with reference to the accompanying drawings.

The above description is only an example describing a technological scope of the present invention. Various changes, modifications, and replacements may be made without departing from the spirit and scope of the present invention by those skilled in the art. Therefore, the embodiments disclosed above and in the accompanying drawings should be considered in a descriptive sense only and not for limiting the technological scope. The technological scope of the present invention is not limited by these embodiments and the accompanying drawings. The spirit and scope of the present invention should be interpreted by the appended claims and encompass all equivalents falling within the scope of the appended claims.

DESCRIPTION OF REFERENCE NUMERALS

1: LIGHT SOURCE MODULE FOR VEHICLE
100: HEAT PIPE
200: SUBSTRATE
210: FIRST SUBSTRATE
220: SECOND SUBSTRATE
240: LIGHT-EMITTING DEVICE
250: TERMINAL
260: WIRE
300: BASE
310: THROUGH HOLE
330: BLOCKING MEMBER
340: ROTATION PREVENTING PART

350: SEATING GROOVE
360: TERMINAL SPACE
370: SEPARATING GROOVE
380: SCREW THREAD
390: INNER SPACE
392: CLOSE CONTACT SPACE
394: SPACING SPACE
400: COUPLING PART
500: SNAP RING
600: HEAT SINK
700: JIG

The invention claimed is:

1. A light source module for a vehicle, comprising:

a heat pipe having a plate shape;

substrates provided on both sides of the heat pipe, respectively;

first and second light-emitting apparatuses provided on the substrates, respectively; and a pair of bases including a pair of holes configured to transmit light emitted from the light-emitting device apparatuses, and coupled to outer sides of the substrates, wherein, each of the light-emitting devices apparatuses separately includes a first light-emitting device and a second light-emitting device which are diagonally arranged, wherein a first blocking member is disposed below the second light-emitting device is included of the first light-emitting apparatus, and wherein the first blocking member is disposed on a side surface of the first light-emitting device of the first light-emitting apparatus, and one area of a surface of the first blocking member contacting the light emitted from the second light-emitting device of the first light-emitting apparatus has a right-angled shape.

2. The light source module of claim 1, wherein a distance between the first blocking member and the second light-emitting device the first light-emitting apparatus is 0.02 mm to 0.2 mm.

3. The light source module of claim 2, wherein the second light-emitting device of the first light-emitting apparatus has a spacing distance of 2.5 mm to 4.0 mm from an outer wall of the base, which forms one of the holes.

4. The light source module of claim 1, wherein the pair of bases form a cylindrical shape by being coupled to each other, and outer circumferential surfaces of the pair of bases are coupled to each other by at least one snap ring.

5. The light source module of claim 4, wherein a first groove for seating the snap ring is provided on the base.

6. The light source module of claim 4, wherein the snap ring is provided in a circular strap shape having a certain thickness, and one area of the snap ring has an opening.

7. The light source module of claim 6, wherein a size of the opening is smaller than a diameter of one of the bases.

8. The light source module of claim 1, wherein the substrates include a first substrate and a second substrate, and the first substrate and the second substrate are provided in different shapes.

9. The light source module of claim 8, wherein terminals of the first substrate and the second substrate are electrically connected through wires, and a terminal space through which the wires pass is provided in the pair of bases.

10. The light source module of claim 1, wherein the heat pipe is connected to a heat sink.

11. The light source module of claim 1, wherein an inner space for seating the substrates is provided in the pair of bases, the inner space is divided into a close contact part which is in close contact with both the substrates and a spacing part configured to prevent wiring of the substrates from interference, and a circuit wiring is not provided in a portion of the substrate, which is positioned in the close contact part.

12. The light source module of claim 1, wherein a coupling part is provided in one area of an outside of the pair of bases.

13. The light source module of claim 12, wherein the coupling part is provided with a groove to be coupled to one of the bases, and a rotation preventing part configured to prevent the one of the bases from rotating is provided in one area of the groove.

14. The light source module of claim 1, wherein a second blocking member is disposed below the second light-emitting device of the second light-emitting apparatus, and wherein the second blocking member is disposed on a side surface of the second light-emitting device of the second light-emitting apparatus, and one area of a surface of the second blocking member contacting the light emitted from the second light-emitting device of the second light-emitting apparatus has a right-angled shape.

* * * * *